US010864387B2

(12) United States Patent
MacKay et al.

(10) Patent No.: US 10,864,387 B2
(45) Date of Patent: Dec. 15, 2020

(54) TACTICAL ROPE INSERTION ASSIST DEVICE

(71) Applicants: Jake Travis MacKay, Tuscaloosa, AL (US); Brent Gilbert, Birmingham, AL (US); Logan Brost, Benbrook, TX (US); Richard Gilliland, Hoover, AL (US); Mark Morgan Pelt, Ogden, UT (US); Caleb Clemons, Huntsville, AL (US); Zachary Martin, Charlotte, NC (US); Wesley S. Hunko, Auburn, AL (US)

(72) Inventors: Jake Travis MacKay, Tuscaloosa, AL (US); Brent Gilbert, Birmingham, AL (US); Logan Brost, Benbrook, TX (US); Richard Gilliland, Hoover, AL (US); Mark Morgan Pelt, Ogden, UT (US); Caleb Clemons, Huntsville, AL (US); Zachary Martin, Charlotte, NC (US); Wesley S. Hunko, Auburn, AL (US)

(73) Assignee: Auburn University, Auburn, AL (US)

( * ) Notice: Subject to any disclaimer, the term of this patent is extended or adjusted under 35 U.S.C. 154(b) by 163 days.

(21) Appl. No.: 15/956,906

(22) Filed: Apr. 19, 2018

(65) Prior Publication Data

US 2018/0304105 A1 Oct. 25, 2018

Related U.S. Application Data

(60) Provisional application No. 62/487,021, filed on Apr. 19, 2017.

(51) Int. Cl.
*A62B 1/14* (2006.01)
*A62B 1/12* (2006.01)

(52) U.S. Cl.
CPC . *A62B 1/14* (2013.01); *A62B 1/12* (2013.01)

(58) Field of Classification Search
CPC ..... A62B 1/12; A62B 1/14; A62B 35/0081; A62B 1/08; A62B 1/10
See application file for complete search history.

(56) References Cited

U.S. PATENT DOCUMENTS 252,829 A * 1/1882 Williams ..... A62B 1/14 188/65.3
300,248 A * 6/1884 Greene ..... A62B 1/14 188/65.5
309,097 A * 12/1884 Robb ..... A62B 1/14 182/192

(Continued)

*Primary Examiner* — Colleen M Chavchavadze

(57) ABSTRACT

Disclosed is a hinged, two-wheeled device for improving the safety of an individual or object descending along a rope from an elevated position. The device includes a two-piece hinged framed held open by a torsion spring. Each part of the frame contains a wheel with a cut out/channel with a knurled surface to increase the friction between the rope and the device and to prevent the device from disengaging during use. The rope is placed between the two wheels and the handle is pulled down, clamping the device around the rope. The two wheels are connected to viscous rotary dampers that slow the speed of the wheels during descent, preventing the user/object from accelerating in a free-fall and controlling the descent rate to a relatively constant, safer speed.

5 Claims, 7 Drawing Sheets

(56) References Cited

U.S. PATENT DOCUMENTS 383,211 A * 5/1888 Calkins ..... A62B 1/14 188/65.3
485,954 A * 11/1892 Lester ..... A62B 1/14 188/65.5
506,707 A * 10/1893 Matts ..... A62B 1/14 188/65.3
583,776 A * 6/1897 Szpor ..... A62B 1/14 188/65.5
588,889 A * 8/1897 Wabnitz ..... A62B 1/14 182/192
930,580 A * 8/1909 Weinstock ..... A62B 1/10 182/236
3,739,875 A * 6/1973 Clark-Padwicki ..... A62B 1/10 182/6
3,879,016 A * 4/1975 Kankkunen ..... A62B 1/10 242/396
3,907,256 A * 9/1975 Kankkunen ..... A62B 1/12 242/381
4,034,828 A * 7/1977 Rose ..... A62B 1/14 182/5
4,114,726 A * 9/1978 Sentinella ..... A62B 1/06 182/5
4,223,761 A * 9/1980 Sonnberger ..... A62B 1/10 182/5
4,416,351 A * 11/1983 Geurtsen ..... B65H 75/4442 182/233
4,830,340 A * 5/1989 Knitig ..... B60P 7/0823 182/5
5,054,577 A * 10/1991 Petzl ..... A62B 1/14 182/193
5,076,400 A * 12/1991 Petzl ..... A62B 1/14 188/65.5
5,265,696 A * 11/1993 Casebolt ..... A62B 1/14 182/192
5,360,083 A * 11/1994 Hede ..... A62B 1/14 182/5
5,855,251 A * 1/1999 Deuer ..... A62B 1/14 182/192
6,899,203 B1 * 5/2005 Golden ..... A62B 1/14 182/5
7,533,871 B1 * 5/2009 Everett ..... A62B 1/14 182/193
8,167,090 B2 * 5/2012 Michael ..... A62B 1/12 182/231
8,851,232 B2 * 10/2014 Bingham ..... A63B 29/02 182/133
9,482,251 B2 * 11/2016 Moine ..... F16B 2/06
9,604,079 B2 * 3/2017 Merritt ..... A62B 1/14
9,884,209 B2 * 2/2018 Hwang ..... A62B 1/14
2006/0289235 A1 * 12/2006 Chen ..... A62B 1/14 182/192
2008/0210488 A1 * 9/2008 Tarkhani ..... A62B 1/10 182/5
2011/0011672 A1 * 1/2011 Price, Jr. ..... A62B 1/14 182/5
2011/0315480 A1 * 12/2011 Maurice ..... A62B 1/14 182/193
2012/0048651 A1 * 3/2012 Rinklake ..... A62B 1/10 182/234
2012/0261212 A1 * 10/2012 Bonaiti ..... A62B 1/14 182/5

* cited by examiner

TACTICAL ROPE INSERTION ASSIST DEVICE

CROSS-REFERENCE TO RELATED APPLICATIONS

The present application claims benefit of priority under 35 U.S.C. § 119(e) to U.S. Provisional Application No. 62/487,021, filed Apr. 19, 2017, the content of which is incorporated herein by reference in its entirety.

ACKNOWLEDGEMENT

This invention was made with government support funded by the United States Air Force Office of Scientific Research Grant No. FA8650-14-C-7400. The government has certain rights in the invention.

BACKGROUND

The present invention relates to a descent control device for use in descending from a higher elevation to a lower elevation along a rope for use in tactical rope insertions or emergency rope insertions, and more particularly, to a descent control device that uses viscous rotary dampers to control the descent rate.

The invention relates to a descent device comprising a device consisting of a handle connected to a two-piece frame that rotates around a hinge, two wheels, both having a groove similar to that of a sheave, one attached to one piece of the frame and the other attached to the other piece of frame, with each wheel connected to a viscous rotary damper, with said device clamping onto a fixed rope that is attached to an elevated surface, and said wheels rotating around the rope as the user descends, with the viscous rotary dampers preventing the wheels from rotating faster than a certain speed to maintain a safe descent rate.

Tactical rope insertion is essentially an access issue of descending a person or object from an elevated level to a lower level or surface. This is accomplished by utilizing a rope, colloquially called a "fast rope," fixed to an elevated surface or aircraft to allow the person or object to slide down the fixed rope. Typically, a person would use his or her hands and feet as friction brakes to slow the descent rate to a safe level. This process causes many issues, including rope burns and injuries caused by the operator detaching from the rope before reaching the desired lower elevation. Friction brake devices and back-up devices such as force limiting rope brakes may aid in descent to increase safety and efficiency. However, Applicants are unaware of any prior art device that can perform the function of passive descent control without the use of sliding friction while still maintaining the use of a rope fixed to the elevated surface. Additionally, Applicants are unaware of any prior art device that makes use of a hinge and two wheels with grooves similar to a sheave that close around the rope to secure the device to the fixed rope during descent, increasing the safety of the user.

Conventionally, a person utilizing a tactical rope for insertion requires multiple steps. First, the rope must be affixed to an elevated surface, which is typically a rotary wing aircraft, a tower, or a building. Second, the operator must reach their hands out towards the rope and grasp the rope firmly with both hands. Third, the operator must step off of the elevated surface while simultaneously gripping the rope between the operator's two feet. Fourth, the operator must squeeze the rope with their hands and feet to increase the normal force on the rope, creating sliding friction that slows the operator to a safe descent rate. Lastly, the operator must impact the ground at a safe speed and release their hands and feet from the rope.

In addition to this simple system, there are a number of prior art devices that can aid in lowering a person or object from an elevated surface along a fixed rope. Many of these devices use sliding friction to slow the operator or object down during descent. While these devices are generally effective, they are not without their own problems. If the frictional force between the device and the rope is greater than or equal to the force of gravity on the user or object, then the device prevents any descent. If the frictional force is less than the force of gravity on the user or object, then the user or object will constantly accelerate, potentially surpassing the safe descent speed. If the prior art device allows for variable friction to maintain a constant safe descent speed, it typically requires the operator to manually control the amount of friction, preventing such prior art devices from being passive descent devices. Additionally, prior art devices relying upon sliding friction wear out the rope much quicker than a device such as the present invention. Repeated sliding friction along a rope decreases the effective life of the rope.

Other conventional devices may be used to lower a person or object from an elevated surface along a rope fixed to the elevated surface, but in Applicant's experience these devices are not the best-suited devices for tactical rope insertion or emergency rope insertion. These devices cannot efficiently be used in a tactical rope insertion because of the difficulty in loading the device onto the fixed rope and unloading the device from the fixed rope after descent. Additionally, these devices use sliding friction which wears on the fixed rope and decreases the effective life of the fast rope system. Applicants' device utilizes viscous rotary dampers to control the rotational speed of the wheels attached to the rope, passively maintaining the operator's speed at a safe descent rate without wearing out the fixed rope. The hinge design allows the operator to quickly and efficiently attach and detach the rope, increasing the efficiency of a tactical rope insertion.

SUMMARY

In summary, the tactical rope insertion assist device according to the present invention is a device for use in tactical rope insertion or emergency rope descents. The device aims to eliminate the safety concerns associated with tactical rope insertion and improve upon prior art in the field by incorporating a hinge design that is attached and detached from the rope faster, and by incorporating a viscous rotary damper system that slows wheels that are attached to the rope without using sliding friction that decreases the useful life of a fast rope. The present device includes a handle connected to a two-piece frame, consisting of a top frame and a bottom frame, where the handle is attached to the top and bottom frames at a pivot point. The handle, top frame, and bottom frame are connected at the pivot point by a bolt and nut assembly, and the pivot point contains a torsion spring that maintains the two-piece frame in the "open position" until the device is placed around the rope and is activated by the user pulling in a downward direction on the handle.

The handle consists of a single elongated piece with two holes, one at both ends and both being holes made through the outer circumference of the handle through the center of the handle. One hole is used to connect the handle to the top frame and bottom frame at the pivot point, and the other hole is one the other end of the handle to allow the operator of the device to attach the device to his person or to an object to be descended, to allow for a passive, hands-free descent of the person or object.

The top frame consists of a body of frame with two holes. The bottom hole, being the smaller hole, is connected to the bottom frame and the handle at the pivot point, and the top hole is larger, and is used to place the wheel and roller shaft assembly.

The bottom frame consists of a body of frame with two holes. The top hole, being the smaller hole, is connected to the top frame and the handle at the pivot point, and the bottom hole is larger, and is used to place the wheel and roller shaft assembly.

A wheel and roller shaft assembly is connected to each piece of frame. Each wheel and roller shaft assembly consists of a wheel, similar to a wide sheave, having a channel in the middle of the wheel and two circular ends, with the two ends having a larger diameter than the channel of the wheel, with the wheel having a conical shape from the edge of the wheel to the inside of the channel. The wheel is connected to a roller shaft, consisting of an elongated round piece with the round face parallel to the circular side of the wheel, with the center point of both the round roller shaft and the round wheel being along the same axis. In a preferred embodiment, each wheel and roller shaft would be one solid piece of material. One roller shaft is placed through the larger hole of top piece of frame, and the other roller shaft is placed through the larger hole of the bottom piece of frame. At the point of connection between the roller shaft and each piece of frame there is a bearing assembly to allow the roller shaft and wheel assembly to rotate independent of the frame.

Connected to each roller shaft, on the opposite end of the wheel, is a viscous rotary damper. Each rotary damper consists of a casing and a damper shaft. Each rotary damper is connected to the frame by four spacers, consisting of small, elongated pieces that screw into the frame, with one viscous rotary damper connected to the top frame and another viscous rotary damper connected to a bottom frame. The casing of each viscous rotary dampers contains four holes, through with the other ends of the spacers are attached. The damper shafts the viscous rotary dampers are connected to the roller shafts on the end of the roller shaft not connected to the wheel. The center point of the damper shaft shall be aligned with the center point of the roller shaft and the center point of the wheel, such that the three center points are along the same center line.

For operation, the device is held by the operator by the handle, and the device is placed such that the two wheels are on opposite sides of the rope, with the center of the rope aligning with the smaller diameters of the wheels, having the larger ends of each wheel on both sides of the rope, such that the rope would fit into the sheave-like groove in each wheel. The bottom wheel must be closer to the operator, with the top wheel being on the side of the rope away from the operator. The operator must pull the handle towards himself and then downward, allowing the hinge design to pinch the two wheels together, with the sheave shape of the wheels encapsulating the rope entirely to prevent the device from disengaging from the rope until the descent is complete. The operator then must place his weight or the weight of the object fully on the device handle in a downward direction. The wheels will grip the rope without slipping, then the wheels will begin to roll downward along the rope, with the viscous rotary dampers preventing the wheels from accelerating to a speed greater than the safe descent speed. Once the desired lower elevation is reached, the operator must lift upwards on the handle, and the torsion spring will extend the two parts of the frame such that the wheels will move away from one another, allowing the operator to remove the device from the rope to complete the process of the descent.

DETAILED DESCRIPTION

Figure 1:
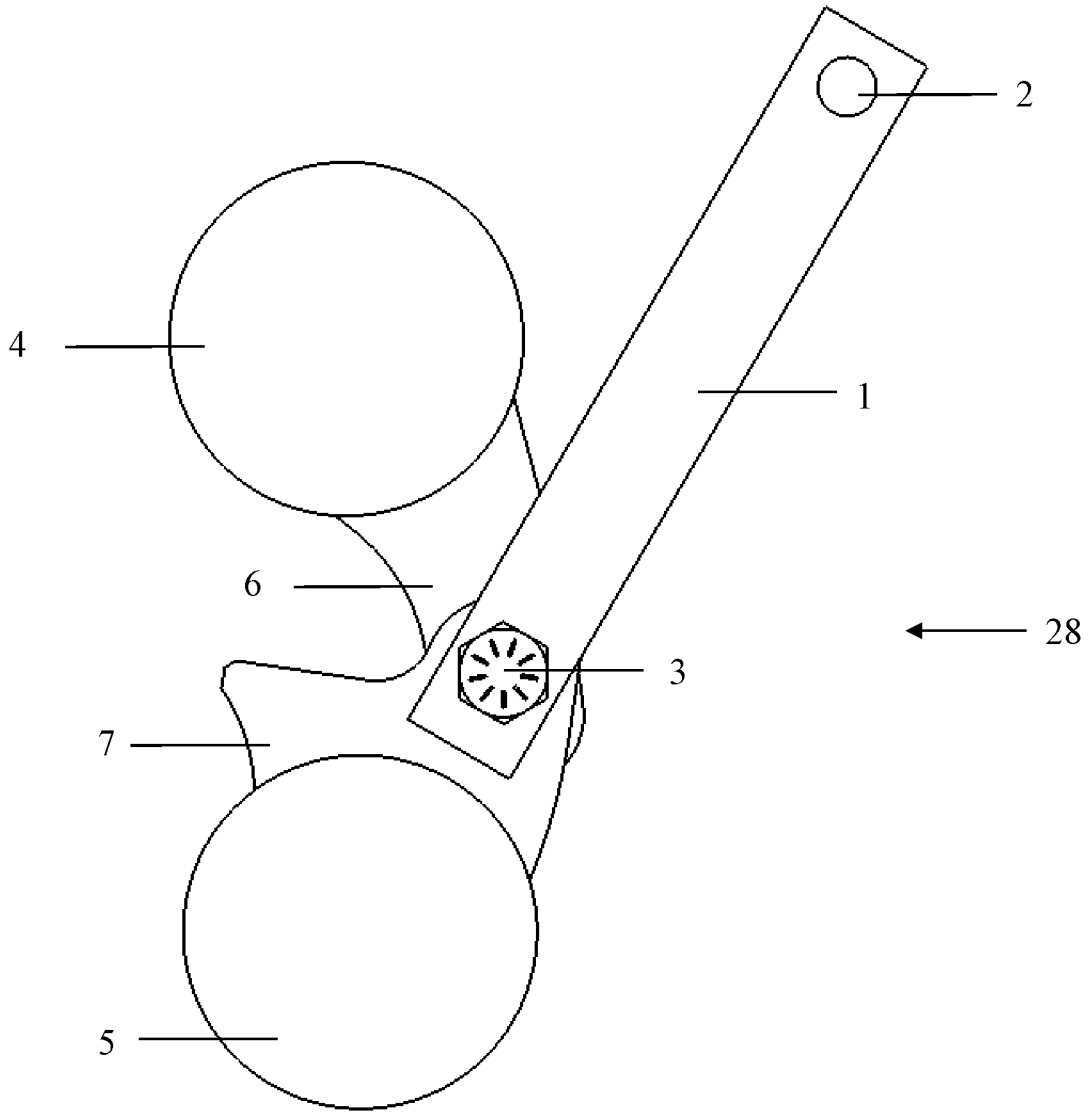
FIG. 1 is, in right side elevation view, the tactical rope insertion assist device according to the present invention.
Figure 2:
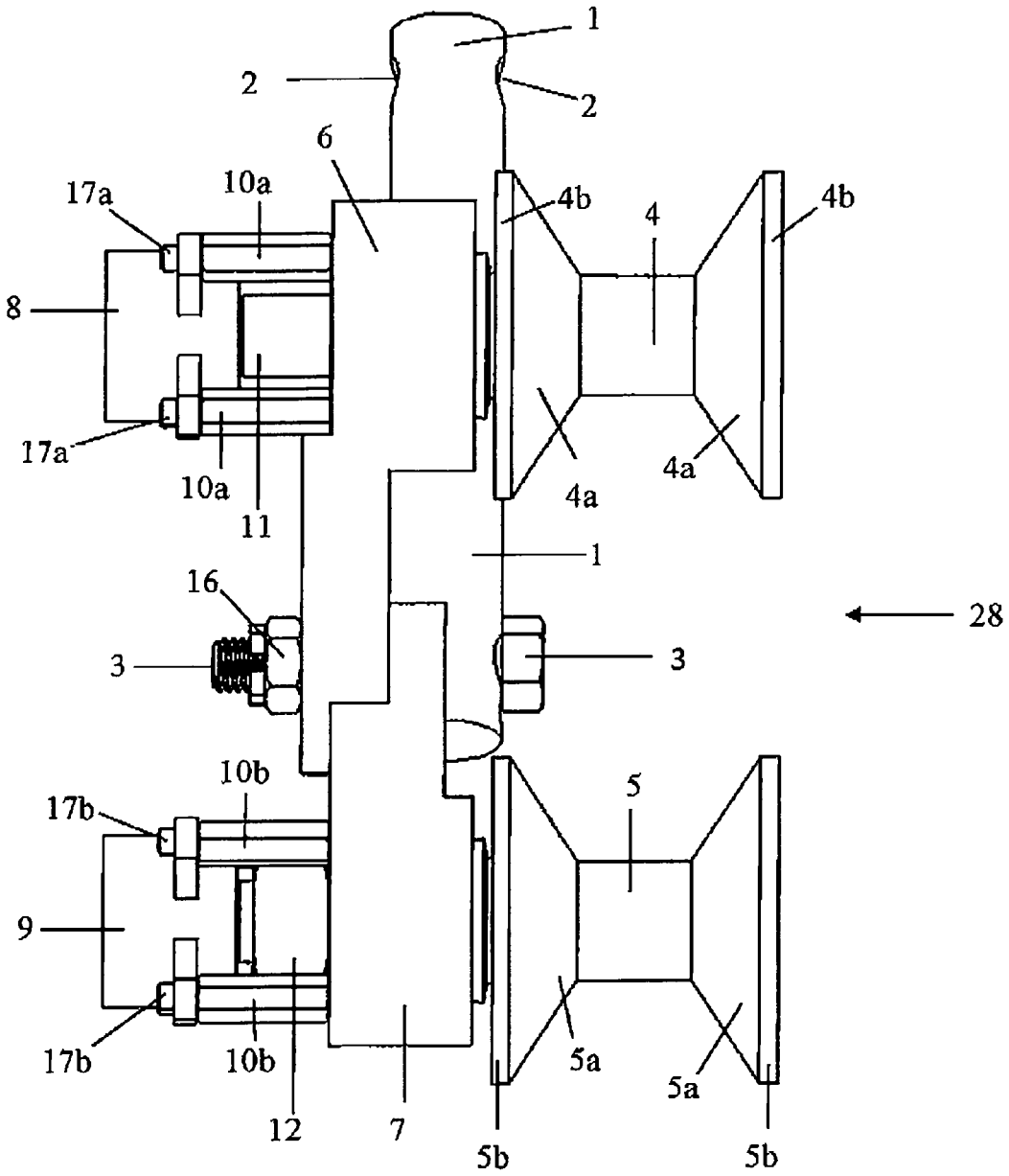
FIG. 2 is, in front elevation view, the device of FIG. 1.
Figure 3:
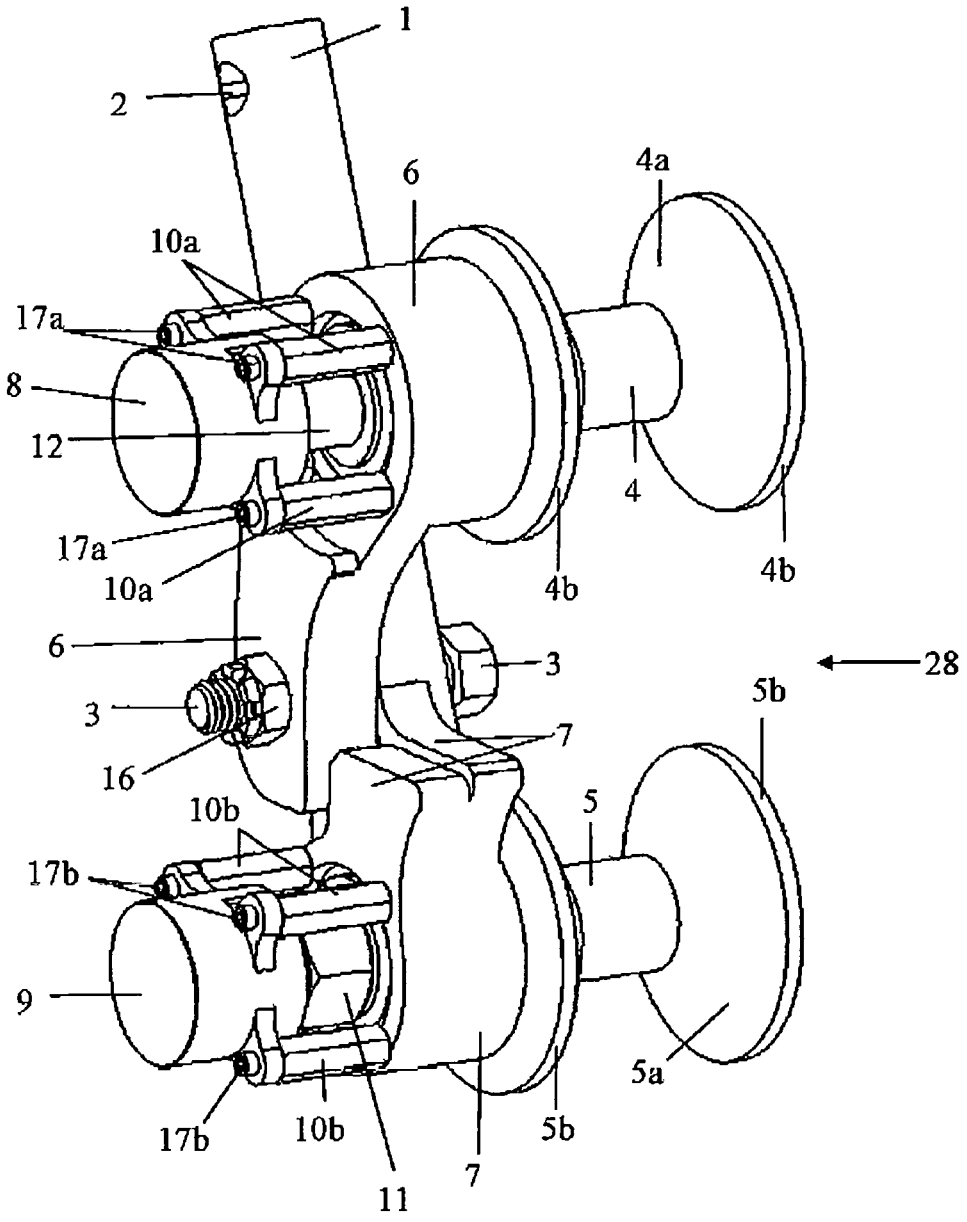
FIG. 3 is, in front left elevation view, the device of FIG. 1.
Figure 4:
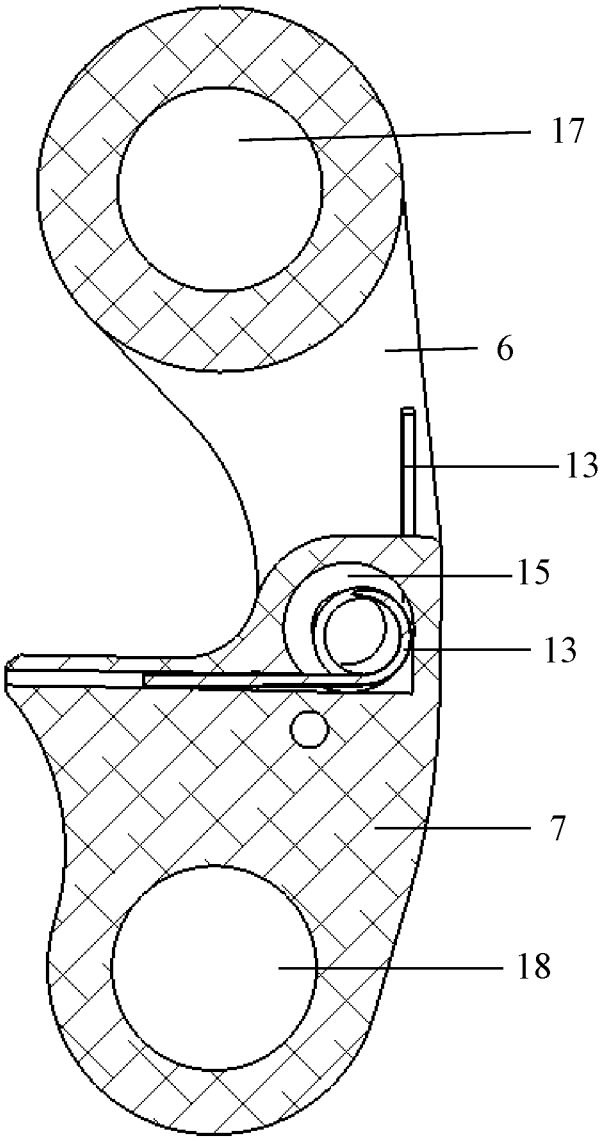
FIG. 4 is, in partially cut away right side elevation view, the device of FIG. 1, showing parts 6, 7, and 13.
Figure 5:
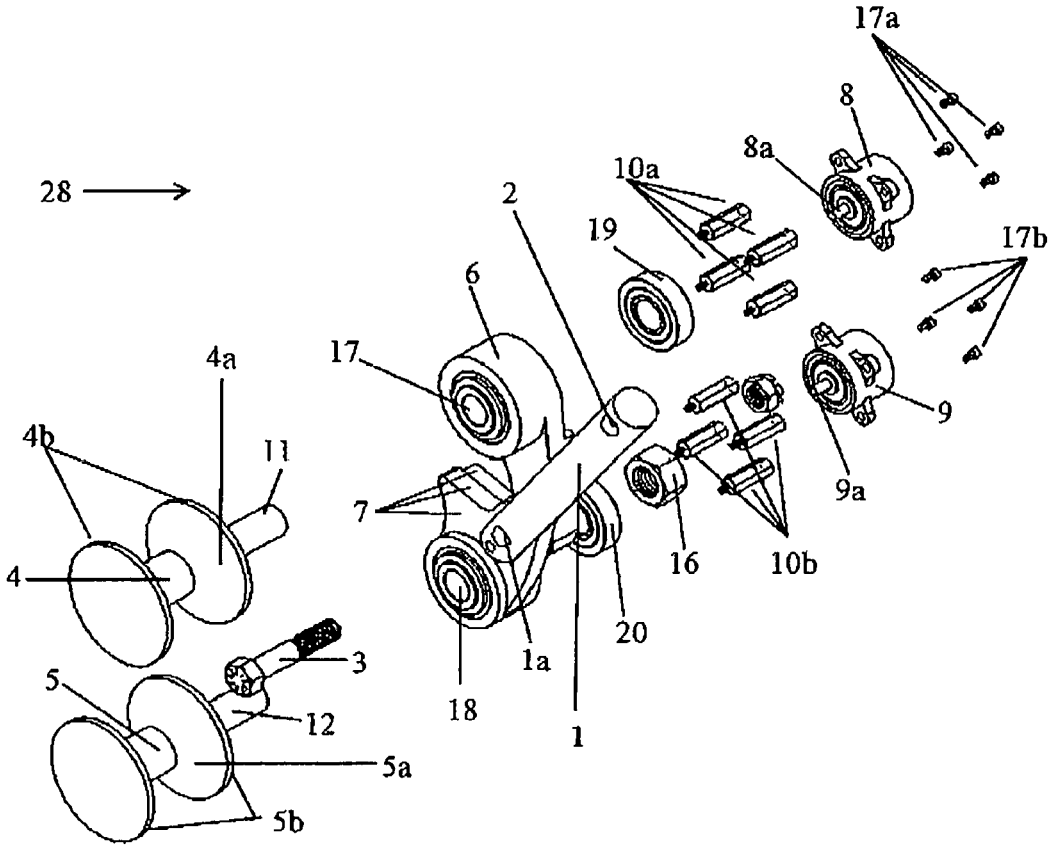
FIG. 5 is, in exploded right rear view, the device of FIG. 1.

The device of the present invention combines the capabilities of, firstly, a passive assist descent control device usable for lowering a person or object from an elevated position to a lower position along a fixed rope, with, secondly, a viscous rotary damper connected to the wheel of the device to prevent the rotational speed from exceeding a safe descent rate, and, thirdly, a hinged frame design held open by a torsion spring to allow the device to be loaded and unloaded quickly without requiring the fixed rope to become detached from the elevated surface and without the operator needing to remove or alter anything on the device itself.

As seen in the accompanying Figures wherein corresponding reference numerals denote corresponding parts in each view, a descent control device 28 for a rope 26 comprises a handle 1 connected to a top frame 6 and a bottom frame 7 by a bolt 3 and nut 16 at a pivot point 15, having a torsion spring 13 connected to the top frame 6 and bottom frame 7 around the pivot point 15, with a preferred embodiment consisting of the bolt 3 and nut 16 securing the handle 1, the bottom frame 7, the torsion spring 13, and the top frame 6 together in that order.

The handle 1 consists of an elongated piece with pivot hole 1*a* at one end and an operator hole 2 at the other end of the handle 1, with the bolt 3 connecting the pivot hole 1*a* with the bottom frame 7 at the pivot point 15, and the operator hole 2 being used in a preferred embodiment to allow the operator or user to attach the device 28 to their body or to an object for passive or hands-free descent.

The top frame 6 connects to the bottom frame 7 and the handle 1 at the pivot point 15 by the bolt 3 and a nut 16. The top frame 6 consists of a single body with a small hole at pivot point 15 on the bottom side through which the bolt 3 is placed, and a larger wheel hole 17 on the top side, through which the wheel 4 and roller shaft 11 are placed. Inside the wheel hole 17, a bearing 19 is used to allow the roller shaft 11 to rotate independent of the top frame 6. In a preferred embodiment, the top frame 6 contains a cut-out around the smaller hole at pivot point 15 inside which the torsion spring 13 is placed. The torsion spring 13 is sandwiched between the top frame 6 and the bottom frame 7.

The bottom frame 7 connects to the top frame 6 and the handle 1 at the pivot point 15 by the bolt 3 and a nut 16. The bottom frame 7 consists of a single body with a small hole at pivot point 15 on the top side through which the bolt 3 is placed, and a larger wheel hole 18 on the bottom side, through which the wheel 5 and roller shaft 12 are placed. Inside the wheel hole 18, a bearing 20 is used to allow the roller shaft 12 to rotate independent of the bottom frame 7. In a preferred embodiment, the bottom frame 7 also contains a cut-out around the smaller hole at pivot point 15 inside which the torsion spring 13 is placed. The torsion spring 13 is sandwiched between the bottom frame 6 and the bottom frame 7.

In a preferred embodiment, the top wheel 4 and the top roller shaft 11 are made out of one solid piece of material. The top wheel 4 has a shape similar to that of a sheave, consisting of a larger outer diameter 4*b* on both outer sides of the wheel, with a section in the middle having a smaller diameter than the outer sides 4*b* of the wheel. The wheel forms a conical shape 4*a* from each outer diameter 4*b* to the middle of the top wheel 4, with the surface of the conical shape 4*a* being knurled in a preferred embodiment to increase the friction between the wheel 4 and the rope 26 to ensure that there is no slipping. The top roller shaft 11 consists of an elongated circular piece with a diameter that fits snug into the top hole 17 of the top frame 6. The end of the top roller shaft 11 opposite of the top wheel 4 connects to the top viscous rotary damper 8, with a top bearing 19 fitted around the top roller shaft 11, with the top bearing 19 fitting into the circular channel cut out of the top frame 6 at the top hole 17.

A top viscous rotary damper 8 is attached to the end of the top roller shaft 11 opposite the top wheel 4. The damper shaft 8*a* of the top viscous rotary damper 8 shall be attached to the top roller shaft 11, with the axis of both being aligned such that both axes are concentric. The top viscous rotary damper 8 will have the properties of a typical viscous rotary damper, with a preferred embodiment being similar to U.S. Pat. No. 5,984,057 A, with the dampening being caused by a viscous fluid. The top viscous rotary damper 8 is attached to the top frame 6 by four identical top spacers 10*a*, being screwed into the top frame 6, and the top spacers 10*a* will be attached to the top viscous rotary damper 8 by screws 17*a* being placed through the frame of the top viscous rotary damper 8 and attaching to the top spacers 10*a*. The top spacers 10*a* shall attach to the top viscous rotary damper 8 such that the frame of the damper 8 shall not rotate, but the damper shaft 8*a* shall rotate along with the top roller shaft 11.

In a preferred embodiment, the bottom wheel 5 and the bottom roller shaft 12 are made out of one solid piece of material. The bottom wheel 5 has a shape similar to that of a sheave, consisting of a larger outer diameter 5*b* on both outer sides of the wheel, with a section in the middle having a smaller diameter than the outer sides 5*b* of the wheel. The wheel forms a conical shape 5*a* from each outer diameter 5*b* to the middle of the bottom wheel 5, with the surface of the conical shape 5*a* being knurled in a preferred embodiment to increase the friction between the bottom wheel 5 and the rope 26 to ensure that there is no slipping. The bottom roller shaft 12 consists of an elongated circular piece with a diameter that fits snug into the bottom hole 18 of the bottom frame 7. The end of the bottom roller shaft 12 opposite of the bottom wheel 5 connects to the bottom viscous rotary damper 9, with a bottom bearing 20 fitted around the bottom roller shaft 12, with the bottom bearing 20 fitting into the circular channel cut out of the bottom frame 7 at the bottom hole 18.

A bottom viscous rotary damper 9 is attached to the end of the bottom roller shaft 12 opposite the bottom wheel 5. The damper shaft 9*a* of the bottom viscous rotary damper 9 shall be attached to the bottom roller shaft 12, with the axis of both being aligned such that both axes are concentric. The bottom viscous rotary damper 9 will have the properties of a typical viscous rotary damper, with a preferred embodiment being similar to U.S. Pat. No. 5,984,057A, with the dampening being caused by a viscous fluid. The bottom viscous rotary damper 9 is attached to the bottom frame 7 by four identical bottom spacers 10*b*, being screwed into the bottom frame 7, and the bottom spacers 10*b* will be attached to the bottom viscous rotary damper 9 by screws 17*b* being placed through the frame of the bottom viscous rotary damper 9 and attaching to the bottom spacers 10*b*. The bottom spacers 10*b* shall attach to the bottom viscous rotary damper 9 such that the frame of the damper 9 shall not rotate, but the damper shaft 9*a* shall rotate along with the bottom roller shaft 12.

Figure 6:
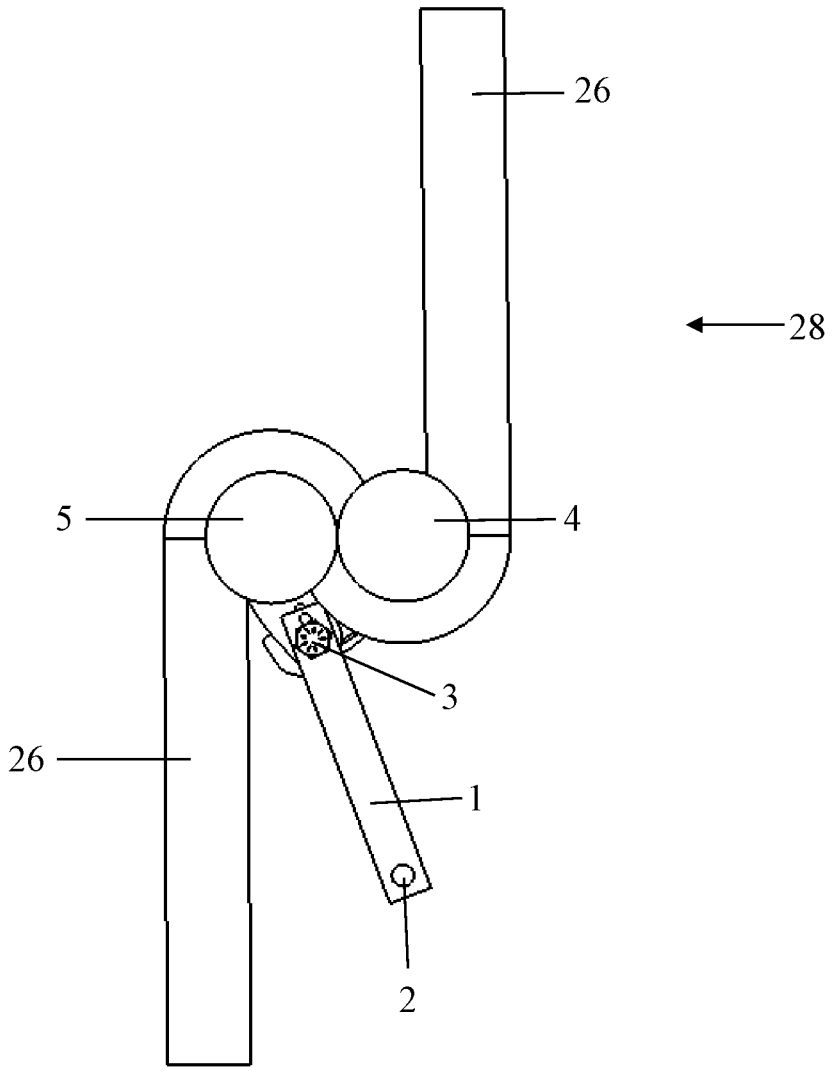
FIG. 6 is, in right side elevation, the device of FIG. 1 in the closed position in place around the fixed rope, numbered part 26.
Figure 7:
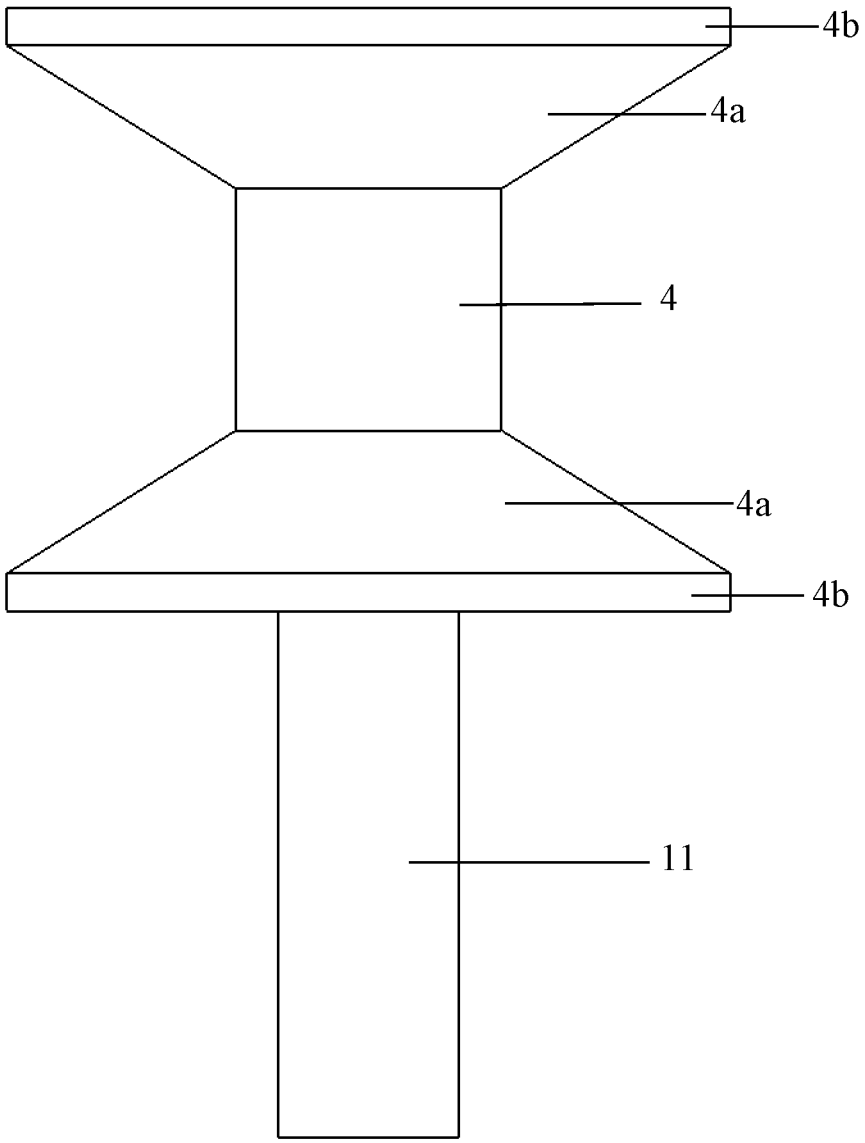
FIG. 7 is, in detailed front elevation view, a wheel, numbered part 5, and a connected roller shaft, numbered part 11, of the device of FIG. 1.

A torsion spring 13 shall be placed in a channel 13*a* between the top frame 6 and the bottom frame 7. The torsion spring 13 is concentric with the pivot hole 1*a*, the pivot point 15, and the bolt 3. The torsion spring 13 will keep the top frame 6 and the bottom frame 7 open such that there is enough space between the top wheel 4 and the bottom wheel 5 to allow the rope 26 to be placed in between them. The torsion spring 13 should be strong enough to keep the tope wheel 4 and bottom wheel 5 apart, but the torsion spring should allow the top frame 6 and bottom frame 7 to rotate such that the top wheel 4 and the bottom wheel 5 clamp around the rope 26 during operation, shown in FIG. 6.

For operation, the device 28 is held by the operator by the handle 1, and the device 28 is placed such that the top wheel 4 and bottom wheel 5 are on opposite sides of the rope 26, with the center of the rope 26 aligning with the smaller diameters of the top wheel 4 and bottom wheel 5, having the larger ends of the top wheel 4*b* and larger ends of the bottom wheel 5*b* on both sides of the rope 26, such that the rope 26 would fit into the sheave-like groove in top wheel 4 and bottom wheel 5. The bottom wheel 5 must be closer to the operator, with the top wheel 4 being on the side of the rope 26 away from the operator. The operator must pull the handle 1 towards himself and then downward, allowing the hinge design to pinch the top wheel 4 and bottom wheel 5 together around pivot point 15, with the sheave shape of the top wheel 4 and bottom wheel 5 encapsulating the rope 26 entirely to prevent the device from disengaging from the rope 26 until the descent is complete. The operator then must place his weight or the weight of the object fully on the device handle 1 in a downward direction. The top wheel 4 and bottom wheel 5 will grip the rope 26 without slipping, then the top wheel 4 and bottom wheel 5 will begin to roll downward along the rope 26, with the viscous rotary dampers 8 and 9 preventing the wheels 4 and 5, respectively, from accelerating to a speed greater than the safe descent speed. Once the desired lower elevation is reached, the operator must lift upwards on the handle 1, and the torsion spring 13 will extend the top frame 6 and bottom frame 7 such that the top wheel 4 and bottom wheel 5 will move away from one another, allowing the operator to remove the device 28 from the rope 26 to complete the process of the descent.

The invention claimed is:

1. A passive-assist descent device for lowering a person or object from an elevated position to a lower position using a rope fixed to the elevated surface, comprising:

an elongated handle connected to a two-piece frame, consisting of a top frame and a bottom frame;

where said top frame pivots around the point where the top frame is connected to the bottom frame;

where the bottom frame is attached to the top frame and the handle, wherein the bottom frame and handle are connected rigidly to one another, such that the top frame may rotate with respect to the bottom frame and handle when rotating around the point where the top frame is attached to the bottom frame;

a top wheel and shaft assembly comprising a top wheel and a top roller shaft configured to share the same axis, attached to the top frame such that the top roller shaft of the top wheel and shaft assembly goes through the top frame, allowing the top wheel and shaft assembly to rotate independent of the top frame;

a bottom wheel and shaft assembly, comprising a bottom wheel and a bottom roller shaft configured to share the same axis, attached to the bottom frame such that the bottom roller shaft of the bottom wheel and shaft assembly goes through the bottom frame, allowing the bottom wheel and shaft assembly to rotate independent of the bottom frame;

a top viscous rotary damper, attached to the top wheel and shaft assembly such that the top viscous rotary damper is connected to the top roller shaft on an end of the top roller shaft opposite to which the top wheel is connected, where said top viscous rotary damper is secured to the top frame on the side of the top frame opposite the top wheel such that the top viscous rotary damper is capable of providing a resisting torque to the top wheel and shaft assembly as it rotates;

a bottom viscous rotary damper, attached to the bottom wheel and shaft assembly such that the bottom viscous rotary damper is connected to the bottom roller shaft on an end of the bottom roller shaft opposite to which the bottom wheel is connected, where said bottom viscous rotary damper is secured to the bottom frame on the side of the bottom frame opposite the bottom wheel, such that the bottom viscous rotary damper is capable of providing a resisting torque to the bottom wheel and shaft assembly as it rotates.

2. The apparatus of claim 1, wherein the descent rate of the device is limited by the resisting torque which is applied to the top and bottom wheel and shaft assemblies of the device, wherein said resisting torque is provided by the viscous rotary dampers, where said resisting torque prevents each wheel from exceeding a certain rotational speed when a constant force is applied to the device, such that the device's acceleration decreases as the device's descent rate increases, where the device's descent reaches a constant, safe descent rate.

3. The apparatus of claim 1, wherein said top and bottom wheel are configured with a large groove in each wheel that acts as a guide for the fixed rope, where the top frame rotates such that the top wheel and bottom wheel clamp around the fixed rope, preventing the device from disengaging until the operator reaches the desired lower position.

4. The apparatus of claim 1, wherein a torsion spring keeps the top wheel and bottom wheel a set distance apart, until the device is placed around the rope and engaged by pulling the handle downward, such that the top wheel and bottom wheel are then capable of clamping the rope together, and wherein said torsion spring extends when the handle is no longer pulled downward, such that the top wheel and bottom wheel separate from their clamping position.

5. The apparatus of claim 2, wherein said descent device is configured to be operated by placing said fixed rope between the top and bottom wheel, where said device is engaged by pulling the handle downwards, allowing the wheels to clamp the rope, where when a force or weight is placed on the device causing said device to descend along the rope, the acceleration of the device is limited by the resisting torque applied directly to said wheels via the viscous rotary dampers connected to the wheel and shaft assemblies, such that the device may passively descend along the rope without requiring any other limiting force.

* * * * *